US007137731B2

(12) United States Patent
Carlson

(10) Patent No.: US 7,137,731 B2
(45) Date of Patent: Nov. 21, 2006

(54) REPLACEABLE MIXING ELEMENTS FOR MOTIONLESS MIXER

(75) Inventor: Richard F. Carlson, Wilmington, CA (US)

(73) Assignee: Komax Systems, Inc., Wilmington, CA (US)

( * ) Notice: Subject to any disclaimer, the term of this patent is extended or adjusted under 35 U.S.C. 154(b) by 464 days.

(21) Appl. No.: 10/812,822

(22) Filed: Mar. 31, 2004

(65) Prior Publication Data

US 2005/0219947 A1 Oct. 6, 2005

(51) Int. Cl.
*B01F 5/06* (2006.01)

(52) U.S. Cl. ..... 366/337

(58) Field of Classification Search ..... 366/336–340, 366/181.5; 48/189.4; 138/37, 39
See application file for complete search history.

(56) References Cited

U.S. PATENT DOCUMENTS 3,051,453 A * 8/1962 Sluijters ..... 366/337
3,923,288 A * 12/1975 King ..... 366/336
4,034,965 A * 7/1977 King ..... 366/336
4,179,222 A * 12/1979 Strom et al. ..... 366/337
4,208,136 A * 6/1980 King ..... 366/338
4,255,124 A * 3/1981 Baranowski, Jr. ..... 431/353
4,674,888 A * 6/1987 Carlson ..... 366/337
4,753,535 A * 6/1988 King ..... 366/337
4,808,007 A * 2/1989 King ..... 366/337
4,824,614 A * 4/1989 Jones ..... 261/76
5,086,846 A * 2/1992 Carlson ..... 169/15
5,283,001 A * 2/1994 Gregoli et al. ..... 516/67
5,378,063 A * 1/1995 Tsukada ..... 366/337
5,484,203 A * 1/1996 King et al. ..... 366/337
5,492,408 A * 2/1996 Alfare ..... 366/337
5,522,661 A * 6/1996 Tsukada ..... 366/337
5,605,399 A * 2/1997 King ..... 366/337
6,676,286 B1 * 1/2004 Grutter et al. ..... 366/337
6,769,801 B1 * 8/2004 Maurer et al. ..... 366/337
7,040,802 B1 * 5/2006 Fuglister ..... 366/337
2002/0060951 A1 * 5/2002 Gruetter et al. ..... 366/337
2005/0219947 A1 * 10/2005 Carlson ..... 366/337

FOREIGN PATENT DOCUMENTS

WO 99/00180 * 1/1999

* cited by examiner

*Primary Examiner*—Charles E. Cooley
(74) *Attorney, Agent, or Firm*—Dergosits & Noah LLP

(57) ABSTRACT

An element for use in a stationary material distribution apparatus. The article includes a flat generally rectangular central portion having first and second sets of ears affixed opposite sides of the central portion. The sets of ears include first and second ears bent respectively in upward and downward directions relative to the plane of the central portion wherein each pair of ears located diagonally opposite one another across the central portion are bent in the same direction relative to the plane of the central portion. A third set of ears extend from the central portion and terminate at a substantially rectangular member whose plane of orientation is substantially perpendicular to the central portion. The element further includes a retaining ring affixed to the substantially rectangular member to provide for ease of installation within a suitable conduit.

9 Claims, 2 Drawing Sheets

REPLACEABLE MIXING ELEMENTS FOR MOTIONLESS MIXER

TECHNICAL FIELD

The present invention relates generally to material distributing and mixing apparatus and particularly to stationary material distribution and mixing apparatus which can be installed within suitable conduit carrying fluids to be mixed on site.

BACKGROUND OF THE INVENTION

Applicant has long ago recognized the desirability of providing a superior line of motionless mixers, that is, mixing elements which do not rely upon any moving parts to create and enhance the mixing operation. For example, in Applicant's U.S. Pat. No. 4,034,965, an invention was disclosed in the form of a motionless mixer created from a plurality of self-nesting, abutting and axially overlapping elements fitted into a conduit. Such elements were found to be capable of not only mixing two or more unlike materials but also of redistributing a single material for thermal or other purposes. Such elements were shown to be capable of fitting into a conduit carrying fluids to be mixed and were shown to be inexpensive to fabricate. Regarding this latter issue, the elements could be punch pressed from flat sheets.

Referring to FIG. 1, Applicant's previously disclosed element 6 includes a central flat portion 10, the plane of which is intended to be generally aligned with the longitudinal axis of the conduit in which it is placed. First and second ears 12 and 14 are rounded or otherwise configured at their outside peripheries for general fit to the wall of the conduit being bent upwardly and downwardly from the flat portion 10. A second pair of ears 16 and 18 at the opposite side of flat portion 10 was shown to be bent upwardly and downwardly, respectively. The angle between various sets of ears was taught to be preferably in the range of about 30 to 120 degrees and were preferably dimensioned to "spring" against the conduit wall so that a good fit is made to the wall without any need for brazing, gluing or otherwise permanently fixing each element to the conduit wall. Various elements were taught to stack or "nest" with respect to one another such that material moving longitudinally within a conduit experiences a counter-clockwise velocity vector or rotational vector imposed by ears 16 and 18 of element 6. The flat portion 10 transforms the rotational vector to a lateral or radial vector. Subsequent to the flat portion 10, ears 12 and 14 impose a further counter-clockwise velocity vector adding somewhat to the lateral or radial vector. It was also noted that ears 16 and 18 impose substantially inward directed radial velocity vector on materials moving longitudinally, where as ears 12 and 14 impose substantially outward directed radial velocity vector. Such devices have been employed for mixing and distributing all types of materials including liquids, solids, gases, foams, etc. Because various "nested" elements were not permanently fastened to each other or to the inner wall of the conduit, the conduit could be a flexible material so that the apparatus could take various curve shapes as may be required in particular applications.

Even though the material distributing and mixing apparatus as disclosed in Applicant's previous U.S. Pat. No. 4,034,965 represented a breakthrough in material distribution and mixing, certain drawbacks were recognized in the use of such apparatus which have been now made the subject of the present invention. For example, it has been recognized that after fluids impacting upon element 6 are acted upon by this mixing element, it can, in some instances, engage in violent rotation causing centrifuging also known as "barber poling." Additionaly, because of the perceived need to properly place mixing elements within a conduit both as individual and "nested" elements, it was believed necessary that mixing apparatus including such elements and supporting conduit would require factory fabrication which, in turn, required shipping of such mixing apparatus as the combination of mixing elements themselves and conduit as a single unit. This obviously added to shipping costs as conduit which could have been provided by an end user on site had to be shipped together with the appropriate mixing elements.

It is thus an object of the present invention to provide a material distributing and mixing apparatus which is improved over prior apparatus by eliminating the limitations are recited above.

These and further objects will be more readily apparent when considering the following disclosure and appended claims.

SUMMARY OF THE INVENTION

The present invention comprises an element for use in stationary material distribution apparatus comprising an article of manufacture having a flat generally rectangular central portion having first and second sets of ears affixed to opposite sides of said central portion. The sets of ears include first and second ears bent respectively in upward and downward directions relative to the plane of said central portion, each pair of ears located diagonally opposite one another across said central portion being bent in the same direction relative to the plane of said central portion and a third set of ears extending from said central portion and terminating at a substantially rectangular member whose plane of orientation is substantially perpendicular to the central portion. A retaining ring is also provided affixed to the substantially rectangular member.

DETAILED DESCRIPTION OF THE INVENTION

Figure 1:
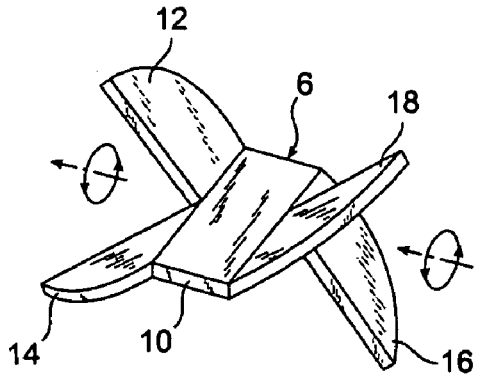
FIG. 1 (PRIOR ART)
FIG. 1 is a perspective view of a prior art mixing element as discussed previously.
Figure 2:
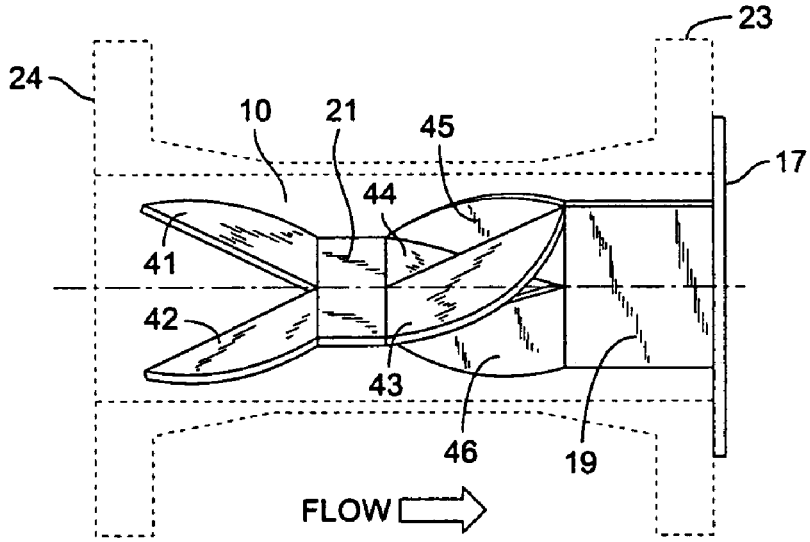
FIG. 2 is a side planar view of a mixing element of the present invention as situated within a suitable conduit.

Turning first to FIG. 2, a stationary material distribution apparatus is shown including article of manufacture 10 having a flat generally rectangular central portion 21 and first and second sets of ears 41, 42, 43 and 44 affixed to opposite sides of central portion 21. Each pair of ears located diagonally opposite one another across central portion 21 are bent in the same direction relative to the plane of the central portion. As such, ear 41 is bent in the same direction as ear 43 and ear 42 is bent in the same direction as ear 44.

Figure 3:
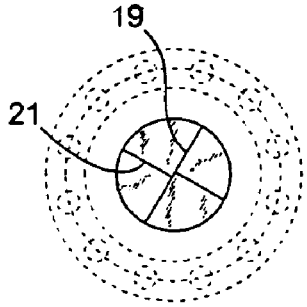
FIG. 3 is a side view of the mixing element and supporting conduit as depicted in FIG. 2.

As noted previously, "barber poling" is substantially prevented in employing the present invention by providing substantially rectangular member 19 which is functionally appended to the remaining portion of article of manufacture 10 through the use of a third set of ears 45 and 46. As noted perhaps most readily by reference to FIGS. 3 and 4, central portion 21 is oriented substantially perpendicularly to substantially rectangular member 19.

An important aspect of the present invention is the ability to install article of manufacture 10 within conduit 22 having flanges 23 and 24 on site. This aspect of the present invention greatly saves shipping costs in not having to provide an end user with a composite installation of article of manufacture 10 and conduit 22 but, rather, provide a means to enable article of manufacture 10 to be installed within conduit 22 on site. This is facilitated by provided retaining ring 17 fixed to substantially rectangular member 19. As noted, retaining ring 17 is provided with radially extending opening 18 sized capture retained substantially rectangular member 19. This composite construction most readily visualized by reference to FIG. 4 enables one to insert article of manufacture 10 within conduit 22 and to be approperly positioned therein by sizing and positioning retaining ring 17 so that it abuts and is flush to flange 23. In doing so, article of manufacture 10 is instantly and reliably and repeatedly positioned within conduit 22 as soon as retaining ring 17 is applied as shown.

Figure 4:
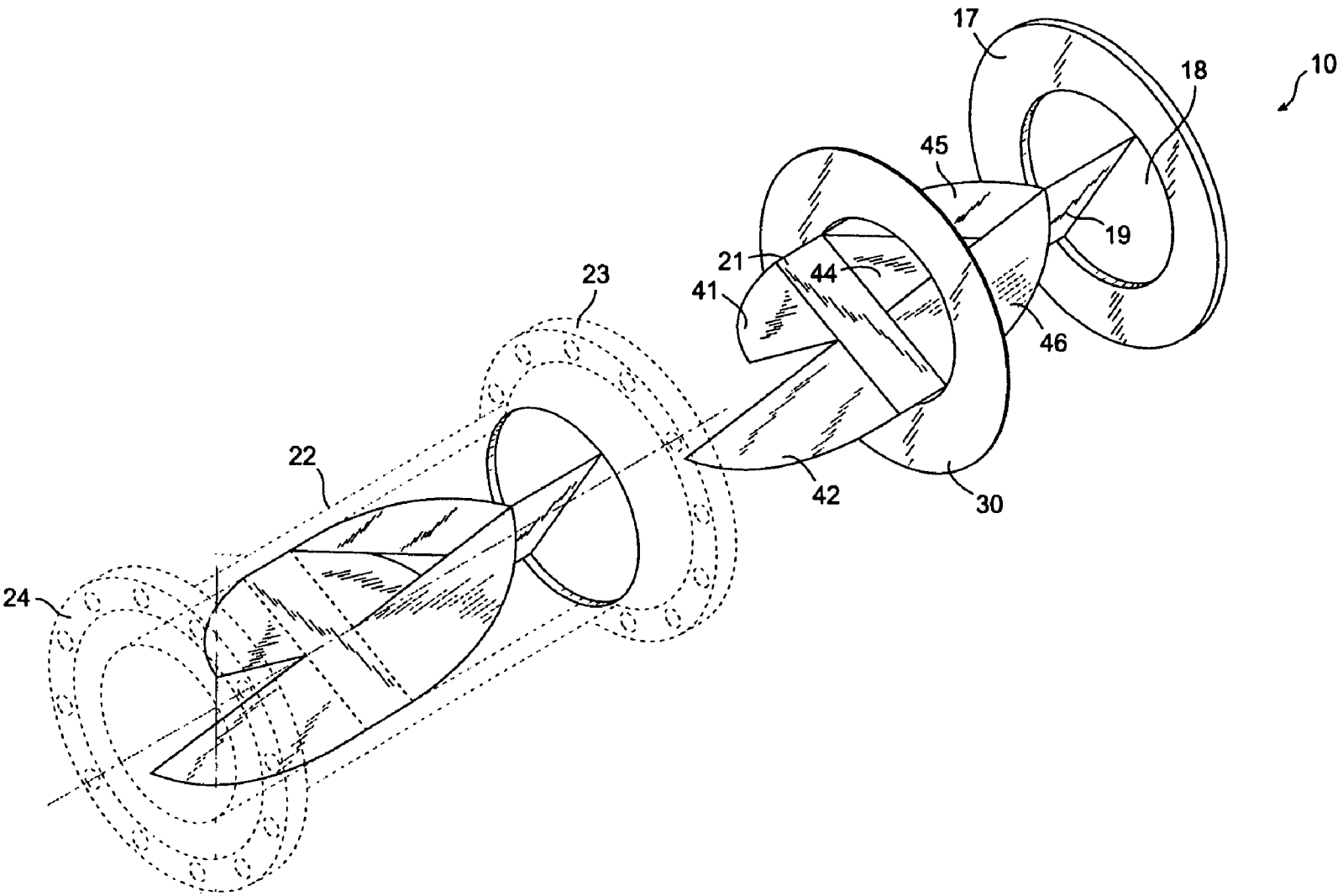
FIG. 4 is an exploded view of the present invention shown in perspective as nesting within a suitable conduit.

As a further expedient, it is noted that a second article of manufacture 10 can be situated within conduit 22 in order to nest with a second such article of manufacture. In doing so, it is quite apparent, perhaps best visualized by reference to FIG. 4 that upstream article 10 differs from the downstream article of like kind by its lack of a retaining ring such as ring 17. In doing so, however, an end user could situate gasket 30 as shown in FIG. 4 to assist in the positioning process.

It is also suggested, as a preferred embodiment, that generally rectangular central portion 21 and substantially rectangular member 19 be rotated from their horizontal and vertical orientations, respectively, by and amount to enhance fluid mixing and distribution. In this regard, as best visualized by referring to FIG. 3, rotating these members and thus article 10 by approximately 30 degrees enables the ears to act as ramps to, again, enhance the mixing operation. For example, when crude oil is to be mixed with water, rotating the article of manufacture as shown in FIG. 2 forces bottom water up into the crude in the internal vortices creating back-mixing by rotating the blend backward from wall to wall of the conduit eliminating wall streaming and produces extremely uniform distribution and droplet size of water in the crude.

The invention claimed is:

1. An element for use in stationary material distribution apparatus comprising:

an article of manufacture having a flat generally rectangular central portion having first and second sets of ears affixed to opposite sides of said central portion, said sets of ears including first and second ears bent respectively in upward and downward directions relative to the plane of said central portion, each set of ears located diagonally opposite one another across said central portion being bent in the same direction relative to the plane of said central portion, a third set of ears extending from said central portion and terminting at a substantially rectangular member whose plane of orientation is substantially perpendicular to said central portion and a retaining ring affixed to said substantially rectangular member.

2. The combination of claim 1 wherein said retaining ring is characterized as having a planar body portion substantially perpendicular to said substantially rectangular member and having a radially extending opening sized to capture and retain said substantially rectangular member.

3. The combination of claim 2 further comprising a conduit in which said article is fitted.

4. The combination of claim 3 wherein said conduit is provided with an upstream end and a downstream end, said retaining ring being positioned proximate said downstream end.

5. The combination of claim 4 wherein said conduit is provided with a flange for connecting said conduit to an adjacent conduit, said retaining ring being sized to abut said flange and to limit extension of said article of manufacture into said conduit.

6. The combination of claim 5 wherein said conduit is characterized as having an inner diameter that is substantially equal to said radially extending opening of said retaining ring.

7. The combination of claim 4 wherein said article of manufacture is removable from said conduit.

8. The combination of claim 4 wherein said conduit is provided with a second article of manufacture positioned within said conduit upstream of said article of manufacture, said second article of manufacture comprising a flat generally rectangular central position having first and second sets of ears affixed to opposite sides of said central portion, said sets of ears including first and second ears bent respectively in upward and downward directions relative to the plane of said central portion, each pair of ears located diagonally opposite one another across said central portion being bent in the same direction relative to the plane of said central portion, a third set of ears extending from said cetral portion and terminating at a substantially rectangular member whose plane of orientation is substantially perpendicular to said central portion.

9. The combination of claim 3 wherein said generally rectangular central portion is rotated approximately 30 degrees from horizontal within said conduit.

* * * * *